United States Patent [19]

Kiuchi et al.

[11] 4,340,660

[45] Jul. 20, 1982

[54] TONER FOR DEVELOPMENT HAVING CROSSLINKED POLYMERS

[75] Inventors: Masashi Kiuchi, Kawasaki; Yoshio Takasu, Tama; Hiroshi Fukumoto, Kawasaki; Takashi Hino, Tokyo; Masaki Uchiyama, Kawasaki; Yasuo Mitsuhashi, Yokohama, all of Japan

[73] Assignee: Canon Kabushiki Kaisha, Tokyo, Japan

[21] Appl. No.: 144,219

[22] Filed: Apr. 28, 1980

[30] Foreign Application Priority Data

Apr. 24, 1979 [JP] Japan ..... 54-56535

[51] Int. Cl.[3] ..... G03 9/08

[52] U.S. Cl. ..... 430/106.6; 430/109; 430/126

[58] Field of Search ..... 430/109, 110, 126, 107, 430/106.6

[56] References Cited

U.S. PATENT DOCUMENTS

| | | | |
|---|---|---|---|
| 2,297,691 | 10/1942 | Carlson | 430/55 |
| 2,825,814 | 3/1958 | Walkup | 430/48 |
| 3,220,324 | 11/1965 | Snelling | 430/35 |
| 3,220,831 | 11/1965 | McFarlane | 430/126 |
| 3,941,898 | 3/1976 | Sadamatsu et al. | 430/109 X |
| 3,965,021 | 6/1976 | Clemens et al. | 430/109 |
| 3,965,022 | 6/1976 | Strong et al. | 430/109 |
| 3,974,078 | 8/1976 | Crystal | 430/109 |
| 3,980,576 | 9/1976 | Vijayendran | 430/109 |

FOREIGN PATENT DOCUMENTS

| | | | |
|---|---|---|---|
| 1165405 | 10/1969 | United Kingdom | 430/67 |
| 1165406 | 10/1969 | United Kingdom | 430/67 |

*Primary Examiner*—Richard L. Schilling
*Assistant Examiner*—John L. Goodrow
*Attorney, Agent, or Firm*—Fitzpatrick, Cella, Harper & Scinto

[57] ABSTRACT

A toner for development comprises a crosslinked vinyl polymer having a gel content of 50–99% and a crosslinked vinyl polymer having a gel content of 10–0%.

7 Claims, 1 Drawing Figure

TONER FOR DEVELOPMENT HAVING CROSSLINKED POLYMERS

BACKGROUND OF THE INVENTION

1. Field of the Invention

The present invention relates to a toner for developing electric latent images or magnetic latent images in electrophotographic methods, electrostatic printing methods or magnetic recording methods, and more particularly, to a toner suitable for fixing the developed images to a support by means of heat roller fixation.

2. Description of the Prior Art

Heretofore, there have been known various electrophotographic processes such as those disclosed in U.S. Pat. Nos. 2,297,691, 2,825,814, 3,220,324 and 3,220,831, British Pat. Nos. 1,165,406 and 1,165,405 and the like. In general, an electrophotographic method comprises utilizing a photoconductive material, forming electric latent images on a photosensitive member by one of various means, developing said latent images with a toner, if desired, transferring the developed toner images to an image receiving member such as paper, and fixing the toner images by means of heat, pressure or solvent vapor.

In addition, there are known various magnetic recording methods for forming magnetic latent images and developing with a magnetic toner.

In connection with these methods, various methods and devices have been developed for fixing toner images onto paper and the like.

The most common method is the so-called heat-roll fixing system where both heat and pressure are simultaneously applied. This method comprises bringing an image receiving sheet bearing toner images into contact with a heated roller to fix the toner images to the image receiving sheet. However, when such fixing system is employed together with a conventional toner, there occur troubles such as offset and the like. Offset is an undesirable phenomenon that a part of toner images carried on an image receiving sheet is transferred onto the surface of the roller.

As mentioned in U.S. Pat. No. 3,941,898, such offset phenomenon is liable to occur when a low molecular weight polymer is used. Therefore, the offset phenomenon seems to be prevented by using a crosslinked polymer as proposed in said U.S. patent. However, the present inventors have found that crosslinked polymers are not always good for such purpose, and in particular, in case of magnetic toners the fixing temperature is raised and the anti-offset property is lowered. In other words, when, for example, various styrene-butyl acrylate copolymers different in the degree of crosslinking were prepared by using divinylbenzene as a crosslinking agent and toners were made therefrom and the fixing property and the anti-offset property were measured, it was found that the higher the degree of crosslinking, the less the offset occurs, but the higher the fixing temperature. The fixing temperature range of the crosslinked polymers is clearly broader than that of the non-crosslinked ones, but the former is not yet at a practically satisfactory level when it is used for a fixing roller having a surface of low releasing property as the result of fatigue.

The surface layer of a roller contacting toner images is usually composed of silicone rubber of fluorine containing resin which is of good releasing property. Some rollers are coated with a releasing oil such as silicone oil and the like so as to prevent offset on the roller surface and fatigue of the roller surface. Such oil coating systems, however, make the fixing device complicated since an oil coating means should be provided, and moreover, the oil evaporated by heat is detestable to the user.

Therefore, such oil coating is not a desirable countermeasure to offset, and at present, researches are directed to development of a toner having wide fixing temperature range and good anti-offset property.

Naturally the toners should have simultaneously excellent anti-blocking property, developing property, cleaning property and the like as well as excellent fixability. Conventional toners have one or more of the following drawbacks. For example, most toners which are easily melted by heat are liable to cake or agglomerate during storage or in a copying machine. Most toners are adversely affected by emvironmental humidity change and therefore the triboelectric property and fluidity become poor. Further in most cases, when toners are continuously and repeatedly used for development, the collision between toner particles and carrier particles and contact of these particles with the surface of a photosensitive surface cause deterioration of the toner particles, carrier particles and photosensitive plate resulting in change of the image density thus obtained, increase in the background density and lowering of the quality of copy. Furthermore, if increase in density of copied images is contemplated by increasing the amount of toner attached to the surface of a photosensitive plate having latent images, usually the background density increases and so-called fog is formed.

In view of the foregoing, toners having excellent toner characteristics and suitable for heat-roller fixation are desired at present.

SUMMARY OF THE INVENTION

An object of the present invention is to provide a toner having excellent physical and chemical characteristics and free from the above mentioned drawbacks.

Another object of the present invention is to provide a toner for heat-roller fixation which has a good fixability and, in particular, has a high anti-offset property.

A further object of the present invention is to provide a toner for heat-roller fixation having good chargeability, capable of exhibiting always a stable chargeability during usage and capable of producing sharp images free from fog.

Still another object of the present invention is to provide a toner for heat-roller fixation having good fluidity, causing no agglomeration, and having excellent impact strength.

A still further object of the present invention is to provide a toner for heat-roller fixation which substantially does not adhere to a toner carrying member or the surface of a photosensitive member.

Still another object of the present invention is to provide a magnetic toner for a magnetic developer exhibiting good and uniform magnetism and capable of being fixed by heat-roller fixation.

According to the present invention, there is provided a toner development which comprises a crosslinked vinyl polymer having a gel content of 50–99% and a crosslinked vinyl polymer having a gel content of 10–0%.

DESCRIPTION OF THE PREFERRED EMBODIMENTS

Figure 1:
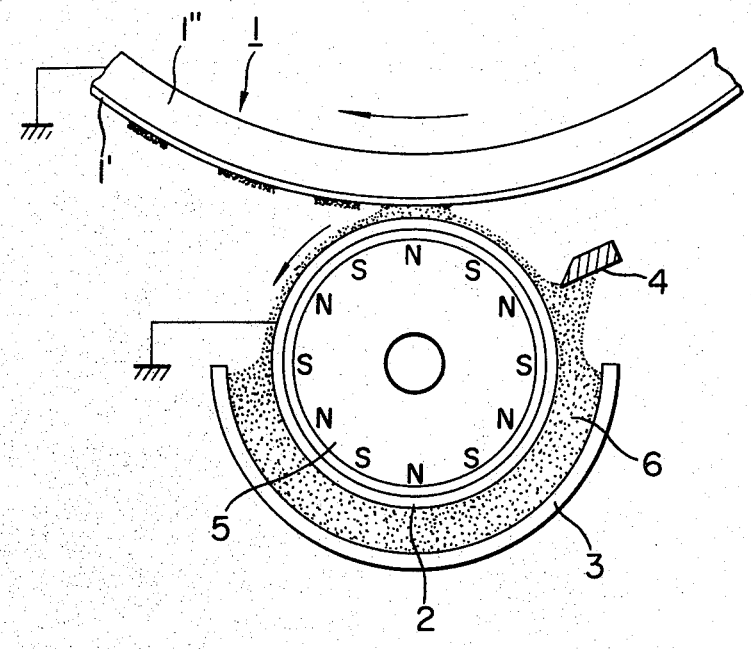
FIG. 1 shows a schematic cross sectional view of a developing device where a magnetic developer is used according to the present invention.

The toner "gel content" in the present invention is a ratio of a polymer portion which is insoluble in a solvent as a result of crosslinking, and is defined as follows:

$$(W_3-W_1)/(W_2-W_1)\times 100(\%)$$

where a particulate polymer (0.5–1 g) is placed in a 80 mesh wire net vessel ($W_1$ g) and exactly weighed ($W_2$ g) and then soaked in toluene at 20° C. together with the vessel to stand for 48 hours, followed by taking out the polymer and the vessel, drying and weighing ($W_3$ g).

As mentioned previously, when the gel content of a polymer in the toner is large, the anti-offset property is good while the fixing temperature is high. On the contrary, when the gel content is small, the fixing temperature is low while the anti-offset property is insufficient. If a polymer having an appropriate gel content is employed, there can be obtained a toner whose fixing temperature is not so high and whose offset property is excellent. Even such polymer can not be so good when a fixing roller which is fatigued and has a lowered releasing property is used.

On the contrary, when the toner of the present invention comprising, as indispensable components, a crosslinked vinyl polymer having a gel content of 50–99% and a crosslinked vinyl polymer having a gel content of 10–0% is applied to such fatigued fixing roller having a lowered releasing property, the fixing temperature in low and the anti-offset property is sufficiently good.

This appears to be attributable to the combination of advantages concerning fixability of these different polymers by polymer blend. The two vinylic polymers having different gel contents preferably have only the same monomer or contain the same monomer.

According to the present invention, the gel content of one crosslinked vinyl polymer is 50–99%. If it is less than 50%, anti-offset property of the toner becomes insufficient while if it is higher than 99%, fixing temperature of the toner disadvantageously becomes remarkably high. The gel content of the other crosslinked vinyl polymer is 10–0%. If it is higher than 10%, the fixing temperature of the toner becomes disadvantageously high.

In general, crosslinked polymers tend to have a poor pigment dispersion property. One of the problems with using crosslinked polymers resides in this point. It is difficult for pigment particles to enter the three dimensional network structure produced by a crosslinking agent. As well known, when the pigment dispersion is poor, the resulting toner particles are non-uniform and therefore, fog is formed upon development and there are formed images of poor resolution. Such toner should be subjected to careful classification so as to remove the particularly non-uniform particles. However, such treatment lowers the productivity to a great extent.

According to the present invention the toner contains a crosslinked polymer of low gel content as an indispensable component, and therefore, dispersability of pigment is not so lowered and good development can be effected. This advantageous effect on development is particularly remarkable where the toner contains magnetic powders which are inherently of poor dispersability.

It goes without saying that the molecular weight of the polymer has a great effect on the fixability of the toner. In general, the higher tha molecular weight, the more the improvement in anti-offset property of the toner. However, the fixing temperature becomes high and therefore, it is not preferable from the viewpoint of energy saving. When the molecular weight is limited to some low range to accelerate the crosslinking, there can be obtained a binder resin having good fixability. The appropriate molecular weight ranges from about 5,000 to 1,000,000. When it is less than 5,000, the resulting anti-offset property is insufficient however high the degree of crosslinking is. When it is higher than 1,000,000, the fixing temperature becomes undesirably high.

Vinyl polymers used in the present invention include homopolymers and copolymers of a vinyl monomer.

As such vinyl monomer, there may be mentioned styrene, styrene derivatives such as α-methylstyrene, p-chlorostyrene, vinylnaphthalene and the like, unsubstituted or substituted monocarboxylic acids having a double bond such as acrylic acid, methyl acrylate, ethyl acrylate, butyl acrylate, dodecyl acrylate, octyl acrylate, phenyl acrylate, methacrylic acid, methyl methacrylate, ethyl methacrylate, butyl methacrylate, octyl methacrylate, acrylonitrile, methacrylonitrile, acrylamide and the like, unsubstituted or substituted dicarboxylic acids such as maleic acid, butyl maleate, methyl maleate, dimethyl maleate and the like, vinyl esters such as vinyl chloride, vinyl acetate, vinyl benzoate and the like, ethylenic olifins such as ethylene, propylene, butylene and the like, vinyl ketones such as vinyl methy ketone, vinyl hexyl ketone and the like, and vinyl ethers such as vinyl methyl ether, vinyl ethyl ether, vinyl isobutyl ether, and the like. These vinyl monomers may be used alone or in combination.

As the polymerization method, there may be mentioned emulsion polymerization, solution polymerization, block polymerization, suspension polymerization and the like. Among them, polymers obtained by emulsion polymerization are most preferable.

As a crosslinking agent, there is mainly used a compound having two or more polymerizable double bonds, for example, aromatic divinyl compounds such as divinyl benzene, divinyl naphthalene and the like, carboxylic acid esters having two double bonds ethylene glycol diacrylate, ethylene glycol dimethacrylate, 1,3-butanediol dimethacrylate and the like, divinyl compound such as divinylaniline, divinyl ether, divinyl sulfide, divinyl sulfone and the like, and compounds having three or more vinyl groups. These compounds may be used alone or in combination. Preferable amount of the crosslinking agent is 0.01–10% by weight based on the total amount of the other monomers.

According to the present invention, it is important that the molecular weight of the crosslinked polymer is appropriately regulated, and as the regulating agent, there may be used known regulating agents, for example, mercaptans, such as lauryl mercaptan, phenyl mercaptan, butyl mercaptan, dodecyl mercaptan, and the like, and halogenated carbons such as carbon tetrachloride, carbon tetrabromide and the like. Preferable amount of the regulating agent is 0–20% by weight based on the monomer.

The mixing weight ratio of the crosslinked vinyl polymer of a gel content of 50–99% to the crosslinked vinylic polymer of a gel content of 10–0% preferably ranges from 10:90 to 90:10, more preferably, from 20:80 to 80:20.

To the toner of the present invention may be added another resin. For example, there may be used homopolymers of styrene and substituted styrene such as polystyrene, poly-p-chlorostyrene, poly-vinyltoluene and the like, copolymers of styrene such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, stryrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, and the like, silicone resins, polyvinyl chloride, polyvinyl acetate, polyethylene, polypropylene, polyesters, polyurethanes, polyamides, epoxy resins, polyvinyl butyral, rosins, modified rosins, terpene resins, phenolic resins, aliphatic or alicyclic hydrocarbon resins, aromatic petroleum resins, chlorinated paraffin, paraffin wax and the like. These resins may be used alone or in combination the amount of the resin is 50% by weight or less, preferably, 40% by weight or less, based on the toner weight.

As a coloring agent used in the present invention, there may be used known coloring agents, for example, dyes and pigments such as carbon black, iron black, graphite, nigrosine, metal camplexes of monoazo dye, ultramarine, phthalocyanine blue, hanza yellow, benzidine yellow, quinacridone and various lake pigments.

When a magnetic toner is desired, there may be added magnetic powders, for example, powders of known magnetic materials such as ferromagnetic elements, alloys thereof, compounds thereof and the like. Examples of such magnetic materials are alloys of iron, cabalt, nickel, manganese and the like such as magnetite, hematite, ferrite and other ferromagnetic alloys.

The magnetic materials usually have an average particle size of 0.1–5 microns, preferably, 0.1–1 micron, and is usually contained in an amount of about 1–60% by weight, preferably 5–40% by weight based on the toner.

The toner of the present invention may be used in various developing methods such as magnetic brush method as in U.S. Pat. No. 2,874,063, cascade developing method as in U.S. Pat. No. 2,221,776, development by an insulating magnetic toner as in Japanese Patent Laid Open Gazette Nos. 42141/1979 and 42142/1979, development by a conductive magnetic toner as in U.S. Pat. No. 3,909,258, development by a highly resistive magnetic toner as in Japanese Patent Laid Open Gazette No. 31136/1978 and the like. Further, the toner may be used for developing magnetic latent images.

In the following some examples of preparing crosslinked vinyl polymers used in the present invention are shown.

All examples set forth hereinafter encompass work which has actually been carried out in accordance with the present invention.

EXAMPLES OF PREPARING CROSSLINKED POLYMERS

I. 70 g styrene, 30 g butyl acrylate, 5 g sodium stearate, 0.8 g divinyl benzene, and 200 g water deionized by ion exchange resins are mixed and placed in a polymerization vessel. To the resulting mexture are added 4 g n-dodecyl-mercaptan and 0.2 g $K_2S_2O_8$ followed by emulsion polymerization for 15 hours at 50° C. to give a styrene-butyl acrylate-divinyl benzene copolymer.

Gel content of the resulting crosslinked polymer is 94%.

II. 60 g styrene, 35 g butyl acrylate, 5 g acrylonitrile, 5 g sodium stearate, 0.7 g divinyl benzene, and 180 g water deionized by ion exchange resins are mixed and placed in a polymerization vessel, and to the resulting mixture and added 5 g n-dodecylmercaptan and 0.3 g $K_2S_2O_8$ followed by emulsion polymerization at 50° C. for 15 hours to give a styrene-butyl acrylate-acrylonitrile-divinyl benzene copolymer.

Gel content of the resulting crosslinked polymer is 87%.

III. Following the procedure of I above except substituting 0.5 g divinylbenzene for 0.8 g divinylbenzene, there is obtained the polymer having a gel content of 77%.

IV. Following the procedure of I above except substituting 0.2 g divinylbenzene for 0.8 g divinylbenzene, the polymer having a gel content of 65%.

V. 70 g styrene, 30 g butyl methacrylate, 5 g sodium stearate, 0.6 g divinylbenzene, and 200 g water deionized by ion exchange resins are mixed and placed in a polymerization vessel. To the resulting mixture are added 5 g n-dodecylmercaptan and 0.3 g $K_2S_2O_8$ followed by emulsion polymerization at 50° C. for 15 hours to give a styrene-butyl methcrylate-divinylbenzene copolymer. Gel content of the resulting crosslinked polymer is 85%.

VI. 65 g styrene, 35 g butyl acrylate, 0.6 g divinylbenzene, 4.5 g disproportionated sodium rosinate, 0.2 g sodium alkylaryl sulfonate, and 200 g water deionized by ion exchange resins are mixed and placed in a polymerization vessel. To the resulting mixture are added 0.1 g p-menthane hydroperoxide, 0.05 g ferrous sulfate, 0.15 g sodium formaldehyde sulfoxylate, 0.07 g sodium salt of EDTA, 0.3 g t-dodecylmercaptan, and 0.5 g sodium phosphate followed by emulsion polymerization at 5° C. for 15 hours to give a styrene-butyl acrylate-divinylbenzene copolymer. Gel content of the resulting crosslinked polymer is 81%.

VII. 50 parts by weight of xylene is placed in a three-necked plask, and 75 parts by weight styrene, 20 parts by weight butyl acrylate, 5 parts by weight butyl maleate, 0.6 parts by weight divinylbenzene and 0.3 parts by weight benzoyl peroxide are added through a dropping funnel under reflux over 3 hours. Then a solution of 0.3 parts by weight benzoyl peroxide in xylene is dropwise added and refluxing is continued for 3 hours followed by cooling and removing the xylene to give a styrene-butyl acrylate-butyl maleate-divinylbenzene copolymer. Gel content of the resulting polymer is 0%.

VIII. Following the procedures of VII above except substituting 1 part by weight of divinylbenzene for 0.6 parts by weight of divinylbenzene, there is obtained the polymer having a gel content of 1%.

IX. Following the procedures of VII above except substituting 0.3 part by weight of divinylbenzene for 0.6 parts by weight of divinylbenzene, there is obtained the polymer having a gel content of 0%.

X. Following the procedures of VII above except substituting 2.0 part by weight of divinylbenzene for 0.6 parts by weight of divinylbenzene, there is obtained the polymer having a gel content of 5%.

XI. Following the procedures of VII above except that the butyl maleate is not used, there is obtained a styrene-butyl acrylate-divinylbenzene copolymer having a gel content of 0%.

The following examples are given for illustrating the present invention, but not for limiting the present invention. Polymer I–Polymer XI in the examples are crosslinked polymers I–XI as obtained above, respectively.

EXAMPLE 1

70 parts by weight of Polymer I(gel content of 94%), 30 parts by weight of polymer VII(gel content of 0%), 40 parts by weight of magnetic powders, and 2 parts by weight of a metal-containing dye (Aapon Fast Black B, tradename, supplied by BASF) were ground and mixed in a ball-mill followed by melting and kneading by a roll mill and then cooled and roughly ground by a hammer mill, and further pulverized by a supersonic jet pulverizer. The resulting powder was classified by an air elutriation to collect the particles of 5–20 microns in size for using as a toner.

The insulating layer surface of a photosensitive drum consisting of an insulating layer composed of a polyester resin, a photosensitive layer composed of CdS and an acrylic resin, and a conductive substrate was uniformly charged to +6 KV by corona discharging, subjected to an imagewise exposure simultaneously with an A.C. corona discharging at 7 KV, and subjected to a blanket exposure to form electric latent images on the surface of the photosensitive member.

The electric latent images were developed by a developing device as shown in FIG. 1. The rotating sleeve and fixed magnet type developing device (The peripheral speed of the sleeve in the same as that of the photosensitive drum, but the rotation directions are just opposite.) was used. The diameter of sleeve 2 was 50 mm in diameter. The magnetic flux density at the surface of sleeve 2 was 700 gauss. The distance between a doctor blade 4 and the surface of sleeve 2 was 0.1 mm. The distance between the sleeve surface and the surface of the insulating layer was 0.15 mm. The above prepared toner 6 was used for the development. 5 denotes a multipolar permanent magnet and 3 denotes a developer vessel. The photosensitive drum 1 is composed of the three layers as mentioned above. The conductive substrate 1'' is grounded. The insulating layer and the photosensitive layer are designated by reference numeral 1' in combination, and the insulating layer is the uppermost layer.

The resulting toner images were transferred to an image receiving paper while a D.C. corona of 7 KV was applied to the image receiving paper from the back side. The toner images thus transferred were fixed by using a heat roller fixing device having no oil coating system of a commercially available dry electrophotographic copying machine (NP-5000, tradename, manufactured by Canon K.K.). There were obtained images in which thin lines were excellently reproduced, and no offset phenomenon was observed and the fixing temperature range was wide. A durability test of 30,000 sheets was effected and it was found that the anti-offset property was good. After the durability test of 30,000 sheets, the fixing roller was fatigued and the releasing force was 150 g. The releasing force is defined as follows and measured according to the following procedure. An adhesive tape of 2 cm wide is adhered to a sufficiently aged fixing roller at 25° C. and then peeled off, and the minimum force for peeling-off is the "releasing force". Practically this force is measured by a spring balance while the adhered adhesive tape is peeled off bit by bit. The releasing force of the fixing roller before use was 10–20 g, but the surface was deteriorated during use and the releasing force increased.

EXAMPLE 2

Following the procedures of Example 1 except that a toner was prepared by using 50 parts by weight Polymer III (gel content of 77%), 50 parts by weight of Polymer VIII (gel content of 1%), 40 parts by weight of magnetic powders, and 2 parts by weight of a metal-containing dye, the result was almost the same as that of Example 1.

EXAMPLE 3

Following the procedures of Example 1 except that a toner was prepared by using 70 parts by weight of Polymer IV (gel content of 65%), 30 parts by weight of Polymer VIII (gel content of 1%), 50 parts by weight magnetic powders, 5 parts by weight of carbon black, and 2 parts by weight of a metal-containing dye, there were obtained clear and sharp images free from fog and the fixing temperature range was wide.

EXAMPLE 4

Following the precedure of Example 1 except that Polymer V(gel content of 85%) was used in place of the Polymer I and a fixing roller having the surface coated with polytetrafluoroethylene was used in place of the fixing roller in Example 1, the result was almost the same as that of Example 1.

EXAMPLE 5

Following the procedures of Example 1 except substituting Polymer VI (gel content of 81%) for the Polymer I and substituting Polymer IX (gel content of 0%) for the Polymer VII, the result was almost the same as that of Example 1.

EXAMPLE 6

Following the procedure of Example 1 for preparing a toner by using 70 parts by weight of Polymer II (gel content of 87%), 30 parts by weight of Polymer XI (gel content of 0%), 10 parts by weight of carbon black, and 2 parts by weight of a metal-containing dye, the resulting toner (12 parts by weight) and a carrier iron powders (88 parts by weight) (EFV 250/400, tradename, supplied by Nihon Teppun Co.) were mixed to produce a developer. The resulting developer was used in a commercially available dry type electrophotographic copying machine (a heat-roller fixing system) to form images. No offset was observed and the image quality was good, and further the fixing temperature range was wide.

EXAMPLE 7

Following the precedures of Example 1 except that a toner was prepared by using 50 parts by weight of Polymer I, 30 parts by weight of Polymer VII, 20 parts by weight of an uncrosslinked styrene-butyl acrylate copolymer (monomer ratio of 7:3), 40 parts by weight of mangetic powders and 2 parts by weight of a metal-containing dye, the resulting toner exhibited a little narrower fixing temperature region than that of Example 1, but there was still obtained a good result.

EXAMPLE 8

Following the precedures of Example 1 except substituting 30 parts by weight of Polymer I and 70 parts by weight of Polymer X for the Polymer I and the Polymer VII, there were obtained clear and sharp fixed images free from fog and no offset to the heat roller was observed.

Comparison Example 1

Following the procedures of Example 1 except that a toner was prepared by using 100 parts by weight of Polymer I (gel content of 94%), 40 parts by weight of magnetic powders, and 2 parts by weight of a metal-containing dye, there were obtained images having a somewhat poorer resolution and a high fixing temperature though the anti-offset property was good.

Comparison Example 2

Following the precedures of Example 1 except that a toner was prepared by using 100 parts by weight of Polymer VII (gel content of 0%), 40 parts by weight of magnetic powders, and 2 parts by weight of a metal-containing dye, good images were obtained, but the anti-offset property was very poor.

Comparison Example 3

A styrene-butyl acrylate copolymer was prepared by following the procedure of preparing polymer I except that the divinylbenzene was omitted. Gel content of the resulting styrene-butyl acrylate copolymer was 0%.

Following the procedures of Example 1 except that a toner was prepared by using 100 parts by weight of the copolymer, 40 parts by weight of magnetic powders, and 2 parts by weight of a metal-containing dye, there were produced good images, but the anti-offset property was very poor.

In the following Table 1 and Table 2, fixability, anti-offset property and image quality of the toner in Example 1 and Comparison Examples 1–3 are shown.

TABLE 1

| | | 150° C. | 160° C. | 170° C. | 190° C. | 210° C. | 230° C. |
|---|---|---|---|---|---|---|---|
| Example 1 | A | O | O | O | O | O | O |
| | B | O | O | O | O | O | O |
| Comparison | A | X | X | O | O | O | O |
| Example 1 | B | O | O | O | O | O | O |
| Comparison | A | O | Δ | Δ | Δ | Δ | Δ |
| Example 2 | B | Δ | X | X | X | X | X |
| Comparison | A | O | Δ | Δ | Δ | Δ | Δ |
| Example 3 | B | Δ | X | X | X | X | X |

A Fixability
B Anti-offset property

The fixability and anti-offset property in Table 1 were measured when the releasing force of the fixing roller was 150 g.

The fixability and anti-offset property were measured and evaluated as shown below.

As to anti-offset property, a pair of heat fixing rollers (the surface of a roller contacting the images being composed of silicone rubber) were used and the speed of paper was 200 mm/sec, and the surface temperature of the fixing rollers was set to a predetermined temperature. A developed and transferred image of whole black was passed through the rollers. The surface of the roller was rubbed with a white flexible paper web (JK Wiper 150, tradename, supplied by Jujo Kimberly Co.). When the web is not smudged, is somewhat smudged and is considerably smudged, it is represented by signs O, Δ and X, respectively.

As to fixability, the fixed image was rubbed then times with the above mentioned web. When the web is hardly smudged and the image is not changed, it is represented by O. When the web is somewhat smudged though the image is not changed, it is represented by Δ. When the web is smudged and the image is changed, it is represented by X.

In Table 2, there is shown the evaluation of image quality for Example 1 and Comparison Example 1.

TABLE 2

| | At the beginning | | | After copying 30,000 sheets | | |
|---|---|---|---|---|---|---|
| | Resolution (lines/mm) | Image density | Fog density | Resolution (lines/mm) | Image density | Fog density |
| Example 1 | 6.3 | 1.20 | 0.00 | 5.6 | 1.12 | 0.01 |
| Comparison Example 1 | 4.5 | 0.81 | 0.03 | 4.0 | 0.70 | 0.05 |

Examples 2–8 also show substantially the same result as Example 1.

In view of the foregoing, the toner in each Example shows good fixability and anti-offset property, and further shows high resolution, high image density and substantially no fog.

What we claim is:

1. In a toner for development comprising a resin and a colorant, the improvement wherein said resin comprises a first crosslinked vinyl polymer having a gel content of 50–99% and a second crosslinked vinyl polymer having a gel content of 10–0%, said polymers being in a weight ratio ranging from 10:90 to 90:10.

2. A toner according to claim 1 in which the gel content of said first polymer ranges from 70 to 95%.

3. A toner according to claim 1 in which the gel content of said second polymer ranges from 5 to 0%.

4. A toner according to claim 1 in which the molecular weight of said vinyl polymers is 5,000–1,000,000.

5. A toner according to claim 1 in which the weight ratio of said first crosslinked vinyl polymer to that of said second crosslinked vinyl polymer ranges from 20:80 to 80:20.

6. A toner according to claim 1 in which said colorant is magnetic powder.

7. A toner according to claim 6 in which the amount of magnetic powder is 1–60% by weight based on the toner.

* * * * *